US006841761B1

(12) United States Patent
Banzato et al.

(10) Patent No.: US 6,841,761 B1
(45) Date of Patent: Jan. 11, 2005

(54) NOMINAL VOLTAGE IDENTIFICATION SYSTEM FOR ELECTRIC RESISTANCE

(75) Inventors: Massimo Banzato, Ternate (IT); Anthony E. Jenkins, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/249,352

(22) Filed: Apr. 2, 2003

(51) Int. Cl.[7] ..... H05B 1/02

(52) U.S. Cl. ..... 219/486; 219/485; 219/492; 219/497; 219/505; 361/78; 361/85

(58) Field of Search ..... 219/483, 485, 219/497, 499, 501, 506, 486, 412–414, 481, 492; 323/235, 236, 319; 307/105, 64, 117; 361/76, 88, 78, 85

(56) References Cited

U.S. PATENT DOCUMENTS 5,101,575 A * 4/1992 Bashark ..... 34/53
5,640,113 A 6/1997 Hu ..... 327/12
5,883,796 A * 3/1999 Cheng et al. ..... 363/40
6,271,506 B1 8/2001 Glaser ..... 219/505

* cited by examiner

*Primary Examiner*—Mark Paschall
(74) *Attorney, Agent, or Firm*—John F. Colligan; Robert O. Rice; Stephen Krefman

(57) ABSTRACT

U.S. Ser. No. 2002009312A cooking appliance having an electric resistance heater is connected to a multiple phase external power source and includes a system for compensating for whether the cooktop is connected to 240V split phase system wherein the two phases are 180° out of phase with each other or a 208V three phase system which has two phases that are only 120° out of phase. In particular, the cooktop includes a system for distinguishing whether the multiple phases of the external power source are 180° out of phase such that the electric resistance heater is compensated against whether it is connected to a three phase external power supply.

12 Claims, 8 Drawing Sheets

NOMINAL VOLTAGE IDENTIFICATION SYSTEM FOR ELECTRIC RESISTANCE

BACKGROUND OF THE INVENTION

The present invention relates generally to identifying electrical power supply systems with different nominal voltages, and more particularly, to identifying electrical power supply systems with different nominal voltages for the purpose of varying the control of an electric resistance heater, for example, such as in electrical cooking apparatus.

DESCRIPTION OF THE RELATED ART

The most common approach to temperature control is to use a closed-loop control wherein the temperature of the heating element or area near the heating element is determined using a sensor, and an automatic control is used to adjust the power to the heating element in order to reach and maintain the desired temperature. A thermostat may be used for this purpose. Although closed-loop temperature control is effective, it is not easy or practicable for some applications, such as in an electric cooktop applications.

In apparatus employing resistive heating elements powered by an external source of electric power or electrical power supply, it is desirable to know the nominal voltage of power supply. For a heating element with a fixed resistance, the power dissipated in the element is proportional to the voltage-squared such that different nominal voltages can result in large changes in element power and heat output.

It is known that household appliances in the U.S. are typically connected to one of two common power supply systems either a 208V three phase system or a 240V split phase system. The 240V split phase system is the more common system and appliance manufacturers normally design and test their appliances to operate using this power system. When cooking appliances having electric heating elements designed for a 240V spilt phase system are connected to a 208V three phase system, the power output of the heating elements is substantially lowered causing foods to cook differently than they would if the appliance was used on the 240V split phase system.

Accordingly, for cooking appliances, it would be desirable to sense which type of power system is connected to the appliance and then modify the operation of the heating element such that such that an appropriate heat output is achieved, regardless of the power system connected to the appliances. In this way, it may be possible for a cooking apparatus or appliance to have proper operation even in systems with different nominal voltages.

SUMMARY OF INVENTION

A cooking appliance having an electric resistance heater is connected to a multiple phase external power source and includes a system for compensating for whether the cooktop is connected to a 240V split phase system wherein the two phases are 180° out of phase with each other or a 208V three phase system which has two phases that are only 120° out of phase. In particular, the cooktop includes a system for distinguishing whether the multiple phases of the external power source are 180° out of phase such that the electric resistance heater is compensated against when it is connected to a three phase external power supply.

Still more specifically, the present invention relates to a system for converting the positive portion of each of the two phases from the external power supply into a square wave signal and evaluating these square waves signals to determine whether the external power supply system is a 240V split system wherein the two phases are 180° out of phase with each other or a 208V three phase system which has two phases that are 120° out of phase and modifying the duty cycle of the heating element accordingly.

DETAILED DESCRIPTION

Figure 1:
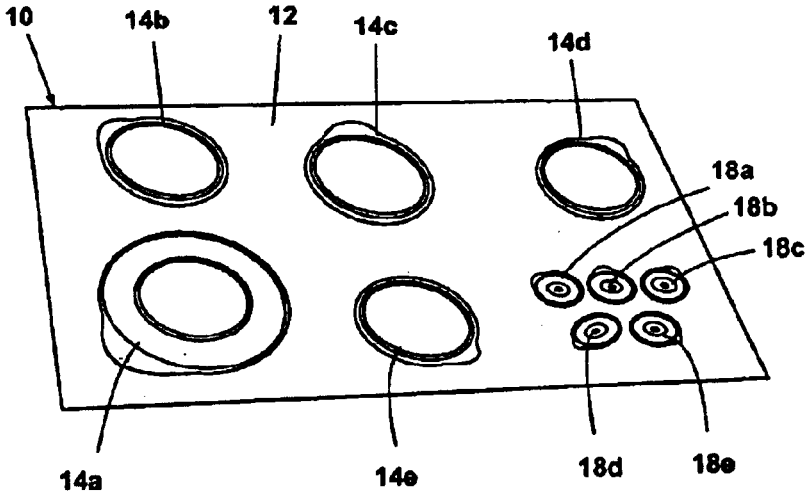
FIG. 1 is a perspective view of a cooktop embodying the power system identification system of the present invention.
Figure 2:
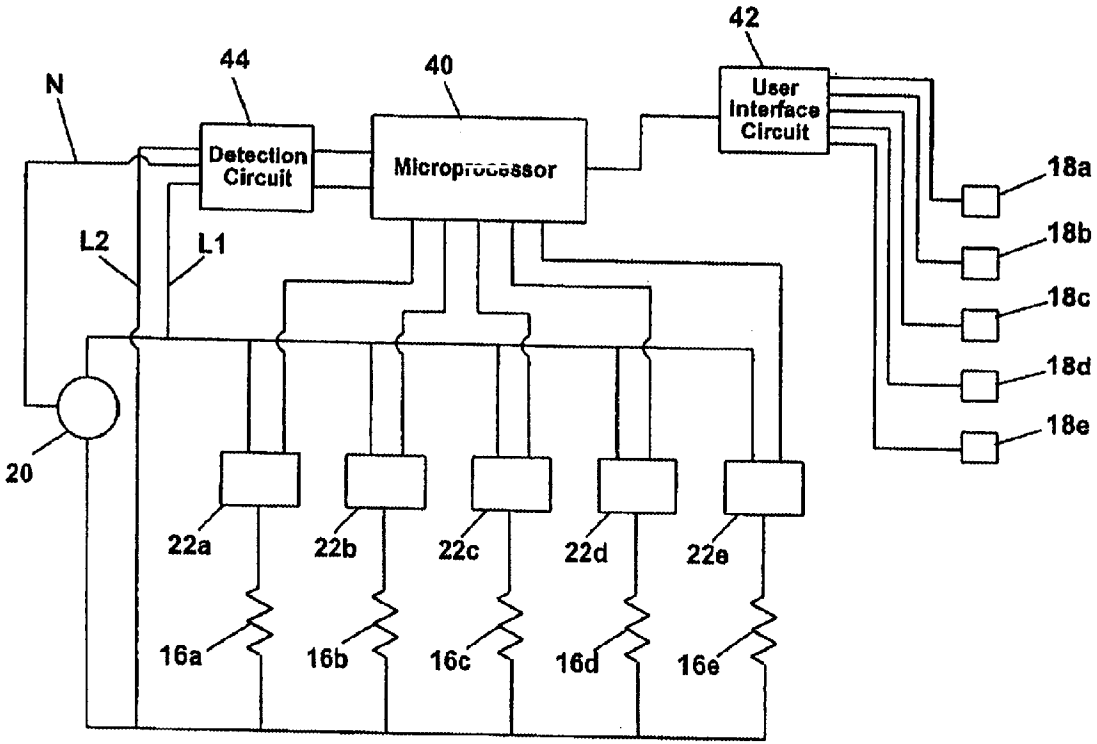
FIG. 2 is a block diagram illustrating the basic elements of the present invention.

FIG. 1 illustrates a cooktop 10 having a top, planar surface 12. The cooktop surface is preferably glass or glass/ceramic material such as sold under the tradename Ceran®. Generally circular patterns 14*a,* 14*b,* 14*c,* 14*d* and 14*e* identify the locations under which are located heating element 16*a,* 16*b,* 16*c,* 16*d* and 16*e* (FIG. 2). The heating elements 16*a*–16*e* may be resistive elements, the simplest case comprising a constant resistance. A plurality of user interface devices 18*a,* 18*b,* 18*c,* 18*d* and 18*e* are provided for allowing users to energize and set the desired temperature of the heating elements 16*a*–16*e*. These user interface devices 18*a*–18*e* can be of any known type including rotary knobs, touch control keys or other type of systems for inputting control to a heating element.

FIG. 2 illustrates in block figure form the control arrangement of the present invention. Each of the heating elements 16*a*–16*e* are coupled to an AC power supply 20 through one of a plurality of power transfer elements 22*a,* 22*b,* 22*c,* 22*d* and 22*e*. The power supply system may be either a 208V three phase system or a 240V split phase system, plus neutral N.

The operation of the power transfer element 22*a*–22*e* is controlled by a controller or microprocessor 40 to control the fraction of time that the power source is connected to the heating elements 16*a*–16*e,* such as by known pulse-width modulation or cycle-skipping methods. The power transfer elements may be triacs or relays or other known devices.

The microprocessor 40 receives input from the input devices 18*a*–18*e* regarding the user selected or desired temperature for the heating elements 16*a*–16*e* via user interface circuit 42 which inputs a user commanded fraction of rated power for the selected heating element. The microprocessor 40 then operates to control the duty cycle of the heating elements 16*a*–16*e* in accord with the user selected temperature, taking into account the sensed power supply system, as determined by detection circuit 44 and described further herein.

Figure 3:
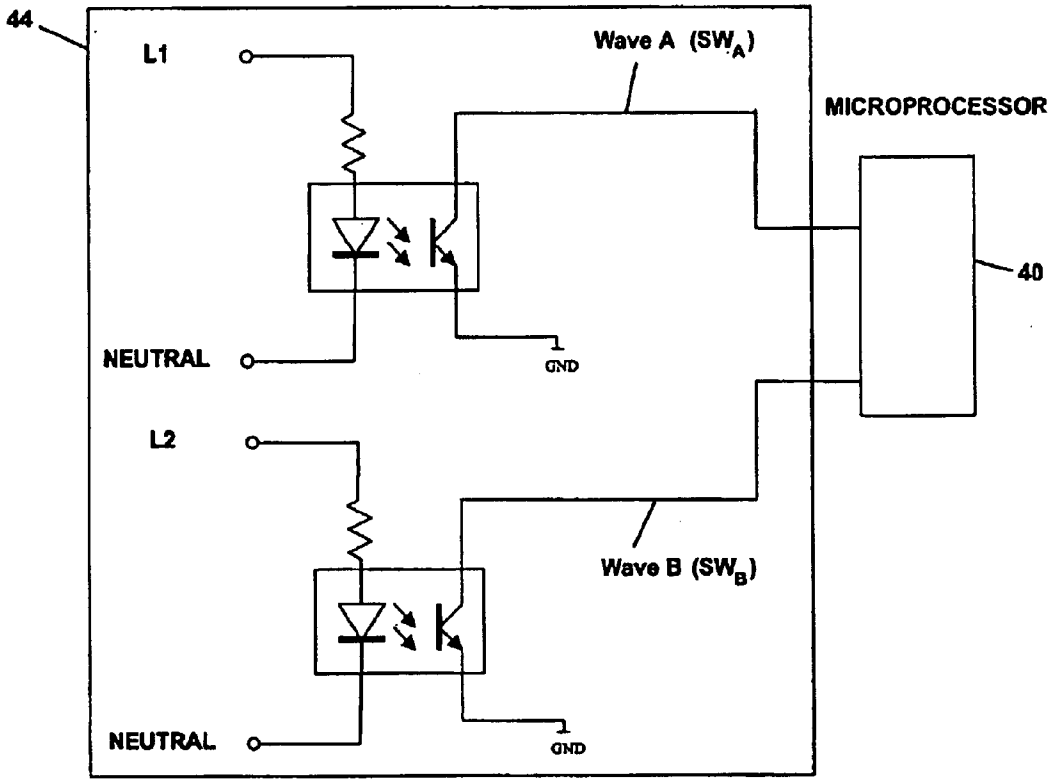
FIG. 3 is a schematic illustration of a detection circuit in accord with the present invention.
Figure 4:
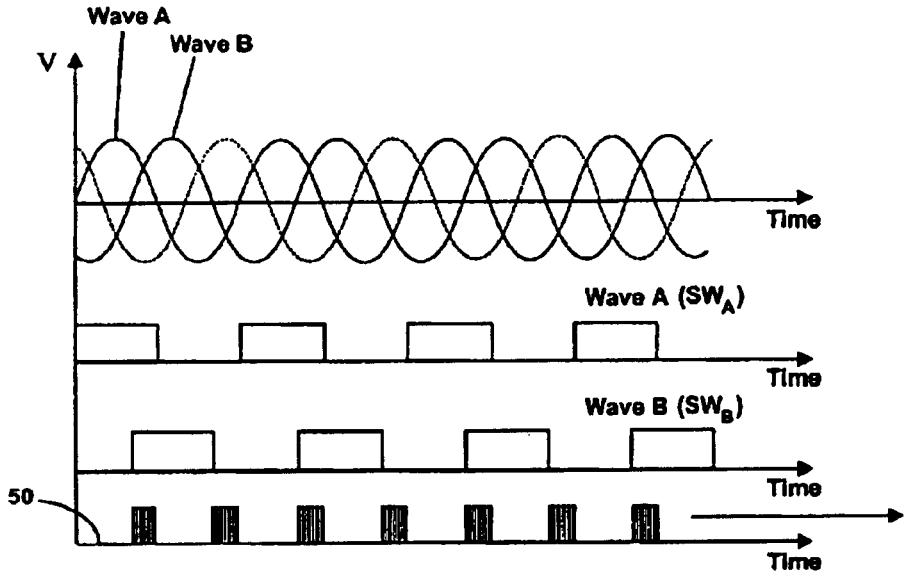
FIGS. 4 and 5 are graphical representations of a 208V three phase power system and a 240V split phase system, respectively.
Figure 5:
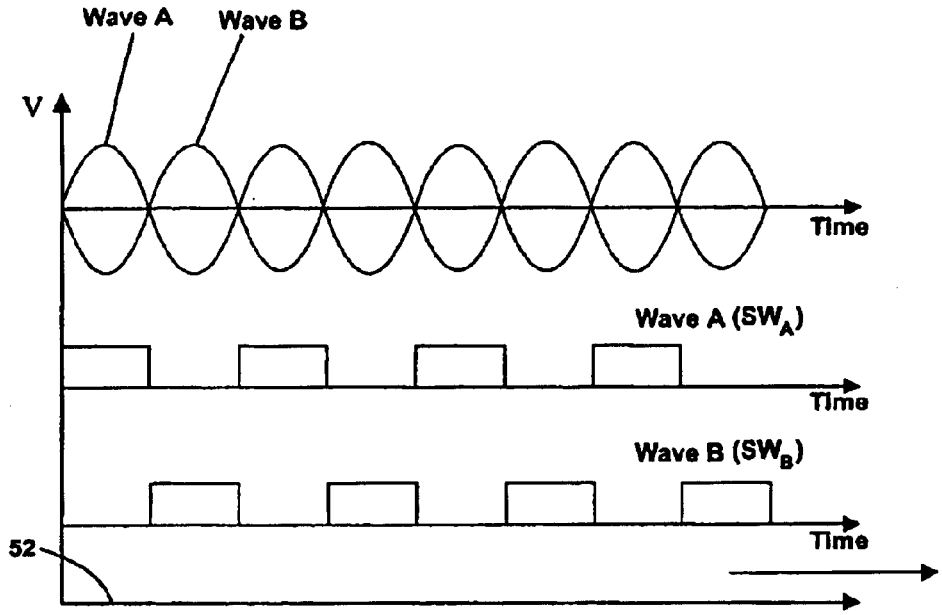

Turning now to FIGS. 3–5, the operation of a detection circuit 44 can be understood. As discussed above, a 208V three phase system includes two phases that are only 120° out of phase with each other (as shown on FIG. 4). A 240V split phase system has two phases that are 180° out of phase with each other (as shown in FIG. 5). The detection circuit 44 operates to exploit this difference to distinguish between the two power systems.

In particular, the detection circuit 44 receives input from L1, L2 and neutral (N), and operates to convert the power signal or wave appearing on lines L1 and L2 into square wave signals $SW_A$ and $SW_B$. These signals, $SW_A$ and $SW_B$, are input into the microprocessor 40 and compared. The microprocessor 40 increments a counter for periods of time when the signals $SW_A$ and $SW_B$ are equal. This occurs during periods when there is an overlap of the signals and during periods where there is no signal, as shown on signal lines 50 and 52 (FIG. 4).

Comparing FIGS. 4 and 5, it is possible to appreciate differences between a 208V three phase system and a 240V split phase system. In FIG. 4, the 208V three phase system is shown in which the different power signals or wave forms appearing on L1 and L2 are 120° out of phase with each other. As a result, the microprocessor increments a counter during periods of time when the signals $SW_A$ and $SW_B$ are equal when the signals overlap and when there is no signal on either line.

In FIG. 5, the 240V split phase system is shown wherein the different signals $SW_A$ and $SW_B$ are 180° out of phase with each other such that, under ideal theoretical conditions, there are no periods of time wherein the signals overlap or wherein there is no signal present. Accordingly, the microprocessor 40 does not increment a counter because the signals $SW_A$ and $SW_B$ are never equal. In actual conditions, there may be some slight overlap of the signals but the total value or number of samples incremented during a period of operation with 240 V split phase power system will be significantly less than then the number of samples incremented under operation with a 208 V three phase system. Accordingly, the microprocessor 40 can readily distinguish between a 208V three phase power system and a 240V split phase system.

Figure 6:
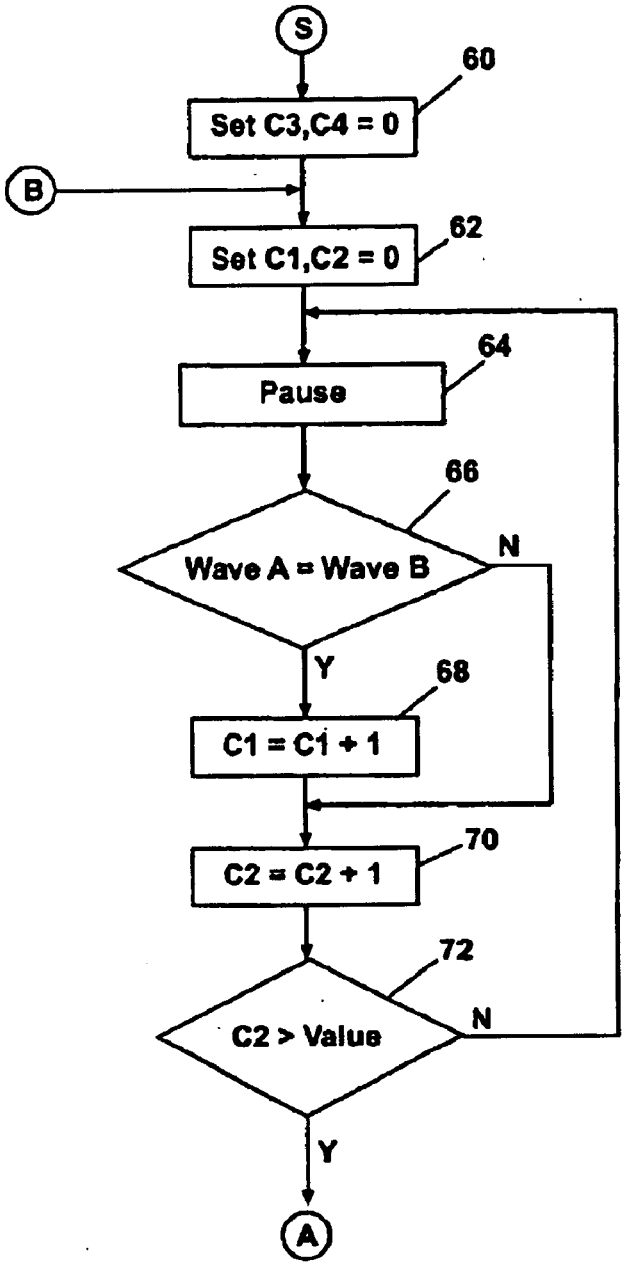
FIG. 6 is a flow diagram of the control routine of the present invention for distinguishing between the 208V three phase power system and a 240V split phase system and selecting the appropriate duty cycle routine.
Figure 6:
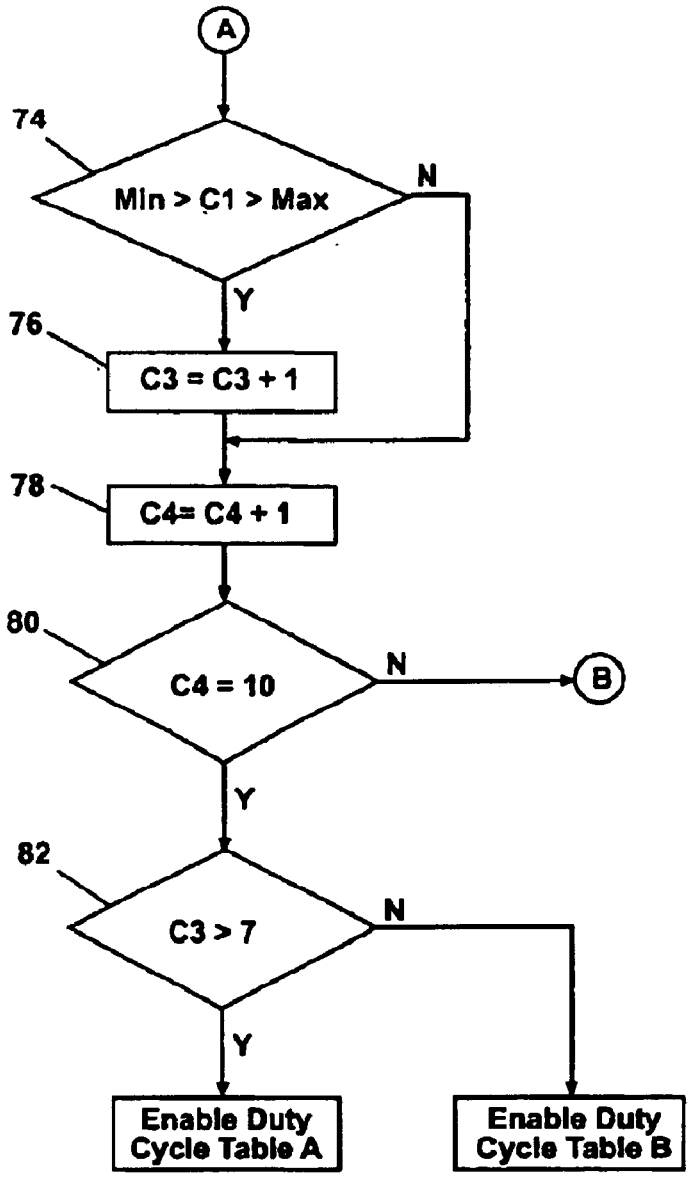

FIG. 6 is a flow diagram illustrating the control routine implemented within the microprocessor 40. Upon connection of the cooking appliance 10 to a power source, the microprocessor 40 enters into a power system check routine. Initially, in steps 60 and 62, the counters C1, C2, C3 and C4 are cleared. At predetermined intervals, such as at every 250 μsec shown by PAUSE step 64, the signals $SW_A$ and $SW_B$ are analyzed and compared to see if they are equal, shown at step 66, as discussed above. If yes, counter C1 is incremented at step 68 and if no, the routine does not increment counter C1. At steps 70 and 72, counter C2 is incremented and compared to a predetermined VALUE to determine if steps 64, 66 and 70 have been iterated a predetermined number of times. In this fashion, the control routine operates to count or sample when signals $SW_A$ and $SW_B$ are equal.

After a predetermined number of iterations occur, control passes to step 74 and inquires whether counter C1 is greater than some predetermined MIN values but less than a predetermined MAX value. This inquiry is designed to account for the fact that even with a 240V split phase system, counter C1 may be incremented occasionally because the signals $SW_A$ and $SW_B$ may not be perfectly shaped in real world environments. The upper limit is utilized to select the default control in the case of erroneous operation.

If counter C1 is between the predetermined values, the counter C3 is incremented at step 76 and if not, the counter C3 is not incremented. The routine then loops back to step 62 to again count and determine if signals $SW_A$ and $SW_B$ are equal, as shown at steps 78 and 80. After a predetermined number of loops, for example 10, shown at step 80, the routine passes onto control step 82 wherein inquiry is made as to whether counter C3 is greater than a predetermined value, such as 7. If yes, the controller 40 implements a duty cycle Table A suitable for use with a 208V three phase power system. If no, the controller implements a duty cycle Table B suitable for use with a 240V split phase system.

Figure 7:
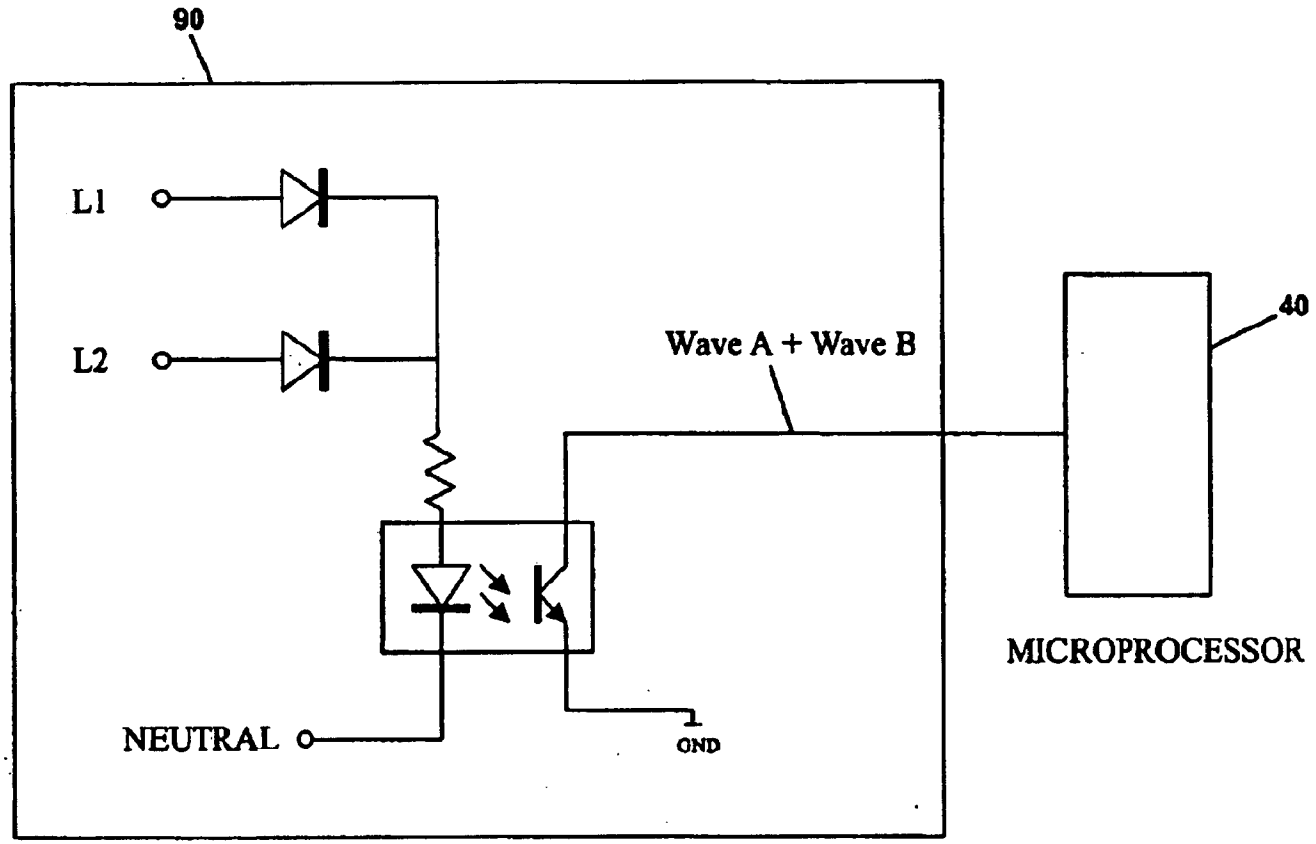
FIG. 7 is a schematic illustration of an alternative embodiment of the detection circuit in accord with the present invention.

Turning now to FIG. 7, an alternative embodiment of the detection circuit can be understood. The detection circuit 90 operates to convert the power signal or wave appearing on lines L1 and L2 into a single square wave signal $SW_{COMB}$. The signal $SW_{COMB}$ is input into the microprocessor 40 and evaluated to determine if the external power supply is a split phase or three phase power system. This evaluation may be performed in different ways, for example by counting the period of time when no signal is present.

As can be understood by one skilled in the art, the detection circuit 44 and detection circuit 90 can be used to distinguish between a three phase and split phase system. Moreover, the applicant appreciates that there may be other detection circuit possibilities. All power system identification circuits that take advantage of the different phase angles of the respective power systems to distinguish between the two systems a 240V split phase system and a 208V three phase system are within the scope of this invention.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A system for controlling an electric resistance heater connected to a multiple phase external power source, comprising:

a user interface device for selecting a desired temperature level for the electric resistance heater;

a power line detection circuit for detecting whether the multiple phases of the external power source are 180° out of phase; and a controller for controlling heat output of the electric resistance heater in accord with the desired temperature level from the user interface device and compensating for different power systems by adjusting a duty cycle of the electric resistance heater based on whether the phases of the external power source are 180° out of phase.

2. The system for controlling an electric resistance heater according to claim 1, further wherein the power line detection circuit detects between a 240V split phase system wherein two phases are 180° out of phase with each other and a 208V three phase system which has two phases that are only 120° out of phase.

3. The system for controlling an electric resistance heater according to claim 1, further wherein the external power source has at least two phases or wave signals and the power line detection circuit converts a positive portion of each of the two phases into a square wave signal and counts when the square wave signals are equal.

4. A method for controlling an electric resistance heater connected to a multiple phase external power source, comprising:

inputting a desired temperature level for the electric resistance heater;

detecting whether the phases of the external power source are 180° out of phase; and controlling heat output of the electric resistance heater in accord with the desired temperature level and compensating for different power systems by adjusting a duty cycle of the electric resistance heater based on whether the phases of the external power source are 180° out of phase.

5. The method for controlling an electric resistance heater according to claim 4, further wherein the step of detecting whether the phases of the external power source are 180° out of phase includes detecting between a 240V split phase system wherein two phases are 180° out of phase with each other and a 208V three phase system which has two phases that are only 120° out of phase.

6. The method for controlling an electric resistance heater according to claim 4, further wherein the external power source has at least two phases or wave signals and the method further includes the step of converting a positive portion of each of the two phases into a square wave signal and counting when the square wave signals are equal.

7. A method for controlling an electric resistance heater connected to a multiple phase external power source, comprising:

distinguishing whether the multiple phase external power source is a 240V split phase system wherein the two phases are 180° out of phase with each other or a 208V three phase system wherein the two phases are 120° out of phase; and compensating for different power systems by adjusting a duty cycle of the electric resistance heater based on whether the external power source is a split phase system or a three phase system.

8. The method for controlling an electric resistance heater according to claim 7, further wherein the external power source has at least two phases or wave signals and the method includes the step of converting a positive portion of each of the two phases into a square wave signal and counting when the square wave signals are equal.

9. A method for controlling an electric resistance heater connected to a multiple phase external power source, comprising:

comparing the relative phase angles of the multiple phases of the external power source by converting a positive portion of the multiple phases into a square wave signal and counting when the square wave signals are equal; and adjusting a duty cycle of the electric resistance heater based on the comparison of the phase angles for the multiple phases of the external power source.

10. The method for controlling an electric resistance heater according to claim 9, further wherein the step of comparing the relative phase angles of the multiple phases of the external power source includes detecting between a 240V split phase system wherein two phases are 180° out of phase with each other and a 208V three phase system which has two phases that are only 120° out of phase.

11. The method for controlling an electric resistance heater according to claim 9, further wherein the electric resistance heater is used in a cooking appliance.

12. The method of controlling an electric resistance heater according to claim 11 further comprising the step of comparing the relative phase angles of the multiple phases of the external power source upon initial power up of the cooking appliance.

* * * * *